US007093834B1

(12) United States Patent
Gilley

(10) Patent No.: US 7,093,834 B1
(45) Date of Patent: Aug. 22, 2006

(54) BASEBALL-LIKE GAME DEVICE AND METHOD OF PLAYING

(76) Inventor: Clark H. Gilley, 5033 Briar Tree, Dallas, TX (US) 75248

( * ) Notice: Subject to any disclaimer, the term of this patent is extended or adjusted under 35 U.S.C. 154(b) by 0 days.

(21) Appl. No.: 10/441,290

(22) Filed: May 15, 2003

(51) Int. Cl.
*A63B 69/00* (2006.01)

(52) U.S. Cl. ..... 273/317

(58) Field of Classification Search ..... 473/415, 473/465, 468; 273/317.6, 317
See application file for complete search history.

(56) References Cited

U.S. PATENT DOCUMENTS 1,741,086 A * 12/1929 Zarse ..... 273/317.6
2,812,946 A * 11/1957 Hughes ..... 473/465
3,994,497 A * 11/1976 Cordingley ..... 473/470
4,746,117 A * 5/1988 Noble et al. ..... 473/566
4,781,385 A * 11/1988 Harley ..... 473/468
4,973,061 A * 11/1990 Catherall ..... 473/468
5,732,952 A * 3/1998 Joseph ..... 273/317.6
2002/0147062 A1* 10/2002 Moore, Jr. ..... 473/451
2003/0176243 A1* 9/2003 Joseph et al. ..... 473/415

* cited by examiner

*Primary Examiner*—Mitra Aryanpour

(57) ABSTRACT

A baseball-like game device and a method of playing the device are disclosed. The device includes a bat; a cork having a truncated conical shape; a "single" marker strip; a "double" marker strip; a "triple" marker strip; and a "home run" marker strip. The method includes the steps of attempting, choosing, designating, grasping, gripping, laying, obtaining, picking, placing, reposing, selecting, setting, standing, stepping, and throwing.

2 Claims, 2 Drawing Sheets

BASEBALL-LIKE GAME DEVICE AND METHOD OF PLAYING

FIELD OF THE INVENTION

The present invention relates games, more particularly to a baseball-like game and a method of playing the game.

DESCRIPTION OF THE PRIOR ART

Because baseball is a popular sport, young children learn to play this sport in the organized "Pony League" and "Little League" teams. These players need to develop a proficiency at batting and such development can be achieved only by practice. Sufficient practice is difficult to achieve because of the lack of area, personnel and equipment. Batting practice devices using a baseball secured to the end of a cord have been proposed which allows the ball to be swung along a circular path by the cord so that the hitter can try to hit the ball. While such devices allow the batting practice to be accomplished in a relatively small area, difficulties have been encountered in harming the players because the ball may spiral around and hit the batter.

A wide variety of baseball game devices is currently available on the commercial market and an even larger number of these types of devices are known in the art of baseball game devices, for example, the indoor baseball disclosed by Fegan in U.S. Pat. No. 1,546,483; the tethered ball baseball batting practice device disclosed by Marsh in U.S. Pat. No. 3,552,088; the minature baseball game disclosed by Peterson in U.S. Pat. No. 3,830,497; the baseball batting aid disclosed by Griffin in U.S. Pat. No. 3,934,873; the cushioned bat disclosed by Ament et al. in U.S. Pat. No. 4,705,273; and the sponge ball game disclosed by Ward in U.S. Pat. No. 6,106,416;

While all of the above-described devices fulfill their respective, particular objectives and requirements, the aforementioned patents do not describe a bat; a cork having a truncated conical shape; a "single" marker strip; a "double" marker strip; a "triple" marker strip; and a "home run" marker strip. This combination of elements would specifically match the user's particular individual needs of making it possible to provide a pleasurable means of playing a baseball-like game by using the device in the steps of attempting, choosing, designating, grasping, gripping, laying, obtaining, picking, placing, reposing, selecting, setting, standing, stepping, and throwing. The above-described patents make no provision for a bat; a cork having a truncated conical shape; a "single" marker strip; a "double" marker strip; a "triple" marker strip; and a "home run" marker strip.

Therefore, a need exists for a new and improved baseball-like game device having a bat; a cork having a truncated conical shape; a "single" marker strip; a "double" marker strip; a "triple" marker strip; and a "home run" marker strip. In this respect, the baseball-like game device according to the present invention substantially departs from the conventional concepts and designs of the prior art, and in doing so provides an apparatus primarily developed for the purpose of providing a pleasurable means of playing a baseball-like game by using the device in the steps of attempting, choosing, designating, grasping, gripping, laying, obtaining, picking, placing, reposing, selecting, setting, standing, stepping, and throwing.

SUMMARY OF THE INVENTION

The present device and method of using, according to the principles of the present invention, overcomes the shortcomings of the prior art by providing a novel and nonobvious baseball-like game device and method of using are disclosed. The device includes a bat; a cork having a truncated conical shape; a "single" marker strip; a "double" marker strip; a "triple" marker strip; and a "home run" marker strip. The method includes the steps of attempting, choosing, designating, grasping, gripping, laying, obtaining, picking, placing, reposing, selecting, setting, standing, stepping, and throwing.

In view of the foregoing disadvantages inherent in the known type of baseball-like game devices now present in the prior art, the present invention provides an improved baseball-like game device, which will be described subsequently in great detail, is to provide a new and improved baseball-like game device which is not anticipated, rendered obvious, suggested, or even implied by the prior art, either alone or in any combination thereof.

To attain this, the present invention essentially comprises a bat; a cork having a truncated conical shape; a "single" marker strip; a "double" marker strip; a "triple" marker strip; and a "home run" marker strip.

There has thus been outlined, rather broadly, the more important features of the invention in order that the detailed description thereof that follows may be better understood, and in order that the present contribution of the art may be better appreciated.

The invention may also include an optional "pitcher" marker strip may be added to the device. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved baseball-like game device that has all the advantages of the prior art baseball-like game device and none of the disadvantages.

It is another object of the present invention to provide a new and improved baseball-like game device that may be easily and efficiently manufactured and marketed.

An even further object of the present invention is to provide a new and improved baseball-like game device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new baseball-like game device that provides in the apparatuses and methods of the prior art some of the advantages thereof, while simultaneously overcoming some of the disadvantages normally associated therewith.

Even still another object of the present invention is to provide a baseball-like game device having a bat; a cork having a truncated conical shape; a "single" marker strip; a "double" marker strip; a "triple" marker strip; and a "home run" marker strip. This combination of elements makes it possible to provide a pleasurable means of playing a baseball-like game by using the device in the steps of attempting, choosing, designating, grasping, gripping, laying, obtaining, picking, placing, reposing, selecting, setting, standing, stepping, and throwing.

Lastly, it is an object of the present invention to provide a new and improved method of using comprising the steps of attempting, choosing, designating, grasping, gripping, laying, obtaining, picking, placing, reposing, selecting, setting, standing, stepping, and throwing.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and description matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
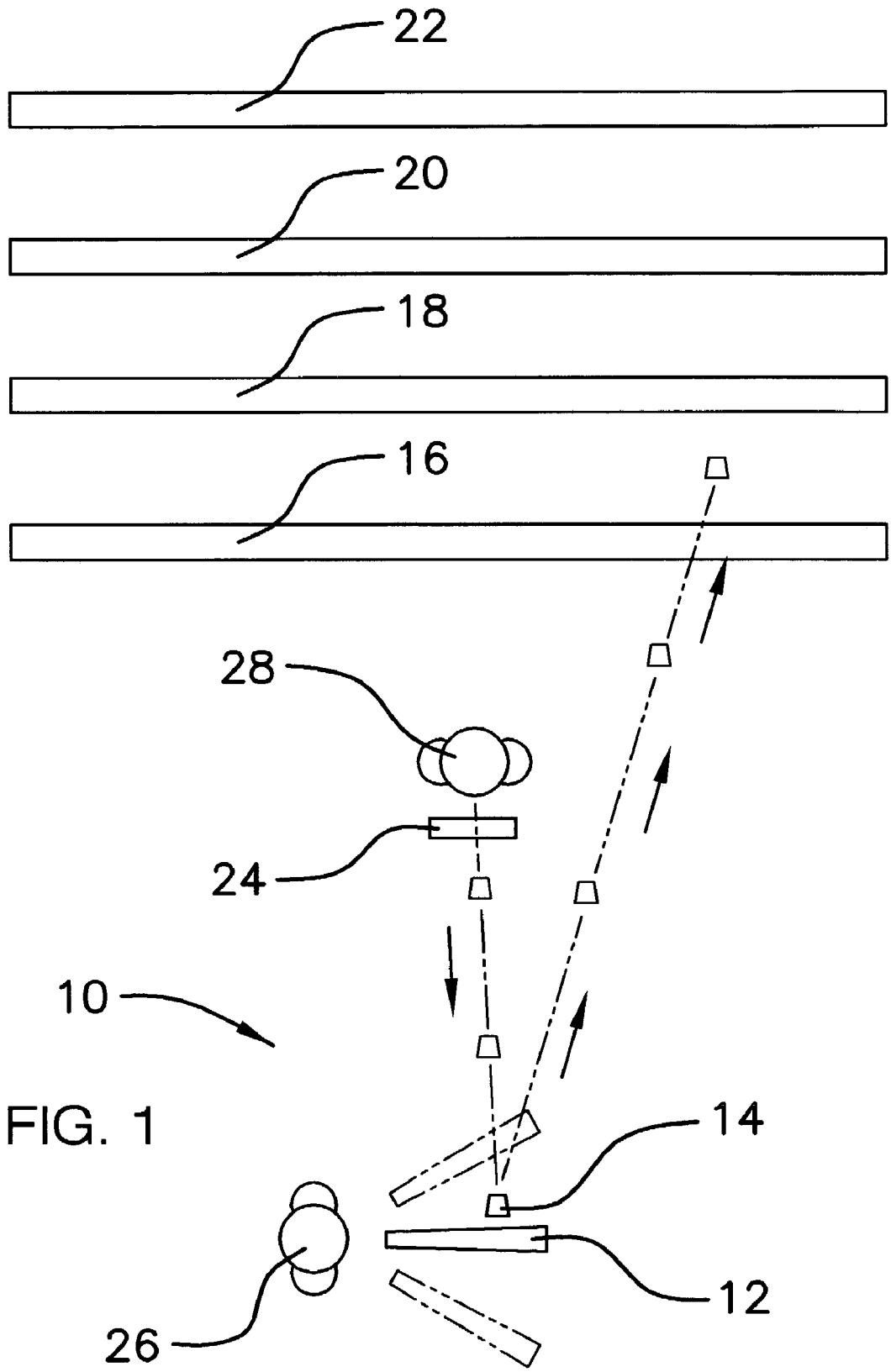
FIG. 1 is an overhead view of an preferred embodiment of the baseball-like game device constructed in accordance with the principles of the present invention.
Figure 2:
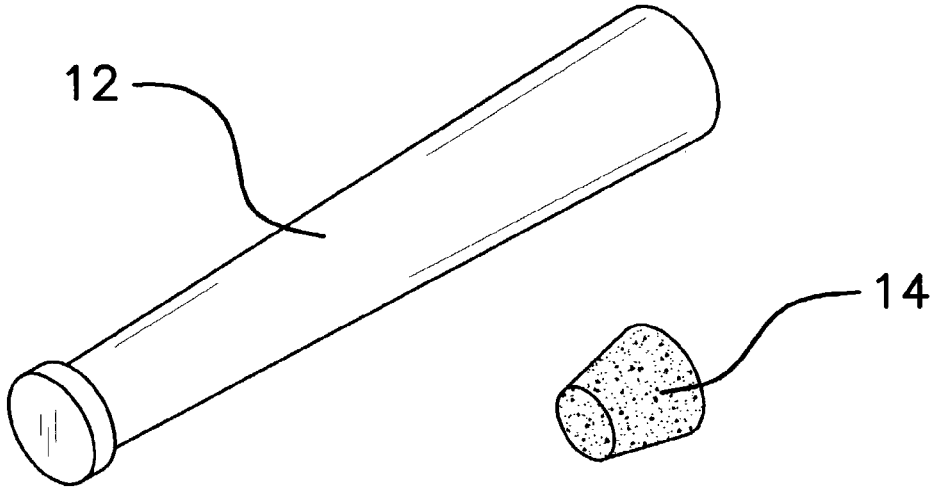
FIG. 2 is a perspective view of some of the components of a preferred embodiment of the baseball-like game device of the present invention.
Figure 3:
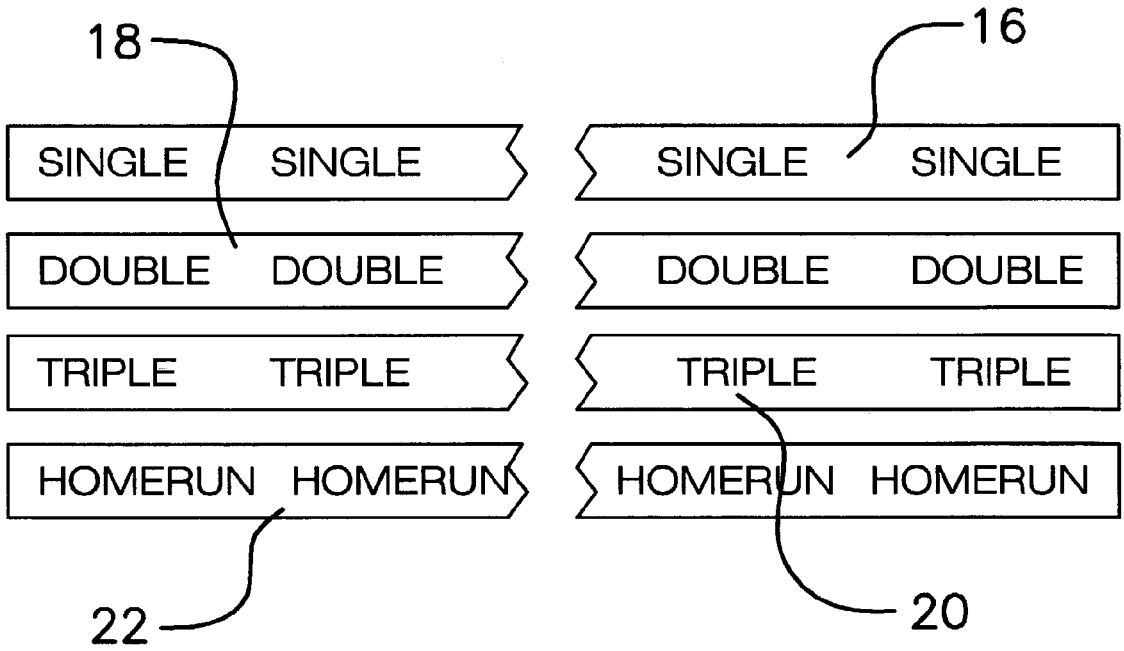
FIG. 3 is a top view of a preferred embodiment of some of the various marker strips of the baseball-like game device of the present invention.

Referring now to the drawings, and in particular FIGS. 1 to 3 thereof, one preferred embodiment of the present invention is shown and generally designated by the reference numeral 10. One preferred embodiment of a baseball-like game device 10 comprises: a bat 12; a cork 14 having a truncated conical shape; a "single" marker strip 16; a "double" marker strip 18; a "triple" marker strip 20; and a "home run" marker strip 22.

Another preferred embodiment of a baseball-like game device 10 consists essentially of: a bat 12; a cork 14 having a truncated conical shape; a "single" marker strip 16; a "double" marker strip 18; a "triple" marker strip 20; and a "home run" marker strip 22.

An optional "pitcher" marker strip 24 may be added to the game device 10.

The bat 12 may be made of any commercially available material. One preferred configuration is that the bat is made of wood selected from the group consisting of ash, aspen, birch, elm, fir, locust, maple, oak, pine, walnut and mixtures thereof. Another preferred configuration is that the bat 12 is made of metal selected from the group consisting of aluminum, tin, nickel, zinc, and iron.

The "single" marker strip 16 may be made of any commercially available material. One preferred configuration of the "single" marker strip 16 may be made of of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The "double" marker strip 18 may be made of any commercially available material. One preferred configuration of the "double" marker strip 18 may be made of of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The "triple" marker strip 20 may be made of any commercially available material. One preferred configuration of the "triple" marker strip 20 may be made of of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The "home run" marker strip 22 may be made of of any commercially available material. One preferred configuration of the home run" marker strip 22 may be made of plastic selected from the group consisting of rubber, neoprene, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The cork 14 may be have any dimension as long as it has a truncated conical shape. One preferred dimensional shape of the cork 14 is that it has a standard taper designation #17 with a height of about 38.1 mm, a top diameter of about 36.5 mm, and a bottom diameter of about 29.4 mm. Another preferred dimensional shape of the cork 14 is that it has a standard taper designation #16 with a height of about 31.8 mm, a top diameter of about 34.8 mm, and a bottom diameter of about 28.8 mm. Yet another preferred dimensional shape of the cork 14 is that it has a standard taper designation #14 with a height of about 31.8 mm, a top diameter of about 31.8 mm, and a bottom diameter of about 25.6 mm. Still yet another preferred dimensional shape of the cork 14 is that it has a standard taper designation #11 with a height of about 31.8 mm, a top diameter of about 27.0 mm, and a bottom diameter of about 21.0 mm. Even yet another preferred dimensional shape of the cork 14 is that it has a standard taper designation #10 with a height of about 31.8 mm, a top diameter of about 25.4 mm, and a bottom diameter of about 19.4 mm. Still yet another preferred dimensional shape of the cork 14 is that it has a standard taper designation #9 with a height of about 28.6 mm, a top diameter of about 23.8 mm, and a bottom diameter of about 18.6 mm. Even still another preferred dimensional shape of the cork 14 is that it has a standard taper designation #7 with a height of about 19.0 mm, a top diameter of about 20.3 mm, and a bottom diameter of about 15.9 mm.

One preferred embodiment of a method of playing a baseball-like game device 10 comprising the steps of attempting, choosing, designating, grasping, gripping, laying, obtaining, picking, placing, reposing, selecting, setting, standing, stepping, and throwing. The obtaining step comprises obtaining the baseball-like game device 10 comprising: a bat 12; a cork 14 having a truncated conical shape; a "single" marker strip 16; a "double" marker strip 18; a "triple" marker strip 20; and a "home run" marker strip 22. The picking step comprises picking out a first person to be a batter player 26. The designating step comprises designating a second person to be a pitcher player 28. The choosing step comprises choosing a first location, the first location is where the batter player 26 is to stand while playing the game device 10. The selecting step comprises selecting a second location about ten feet away from the first location, the second location is where the pitcher player 28 is to stand while playing the game device 10. The laying step comprises laying down the "single" marker strip 16 behind the second location relative to the first and second locations so that a center of the laid down "single" marker strip 16 is substantially in line with the first and second locations and so that the laid down "single" marker strip 16 is laid out substantially perpendicular to a line defined by the first and second locations. The placing step comprises placing down the "double" marker strip 18 behind the laid down "single" marker strip 16 relative to the first and second locations so that a center of the placed down "double" marker strip 18 is substantially in line with the first and second locations and so that the placed down "double" marker strip 18 is placed down substantially perpendicular to the line defined by the first and second locations, wherein the placed down "double" marker strip 18 is substantially parallel to the laid down "single" marker strip 16. The setting step comprises setting down the "triple" marker strip 20 behind the placed down "double" marker strip 18 relative to the first and second locations so that a center of the set down "triple" marker strip 20 is substantially in line with the first and second locations and so that the set down "triple" marker strip 20 is set down substantially perpendicular to the line defined by the first and second locations, wherein the set down "triple" marker strip 20 is substantially parallel to the placed down "double" marker strip 18. The reposing step comprises reposing down the "home run" marker strip 22 behind the set down "home run" marker strip 22 relative to the first and second locations so that a center of the reposed down "home run" marker strip 22 is substantially in line with the first and second locations and so that the reposed down "home run" marker strip 22 is reposed down substantially perpendicular to the line defined by the first and second locations, wherein the reposed down "home run" marker strip 22 is substantially parallel to the set down "triple" marker strip 20. The standing step comprises standing onto the first position performed by the batter player 26. The stepping step comprises stepping onto the second position performed by the pitcher player 28. The grasping step comprises grasping onto the bat 12 performed by the batter player 26. The picking step comprises picking up the cork 14 performed by the pitcher player 28. The throwing step comprises throwing the cork 14 towards the batter player 26, said throwing step is performed by the pitcher player 28. In a preferred embodiment, the throwing step comprises the pitcher player 28 throwing the cork 14 underhanded with a spinning motion. Said spinning motion can be accomplished with the use of one or two fingers and anticipates the pitcher player 28 throwing a curve ball, slider, knuckleball, or otherwise influence the trajectory of the cork 14. The attempting step comprises attempting to hit the thrown cork 14 with the bat 12, said attempting step is performed by the batter player 26.

An optional set of additional steps may be added to the above method further comprising the steps of earning, garnering, getting, procuring, receiving, and securing. The receiving step comprises receiving by the batter player 26 a "strike" point when the batter player 26 misses the thrown cork 14 while attempting to hit the thrown cork 14. The securing step comprises securing by the batter player 26 a "single" point when the batter player 26 hits the thrown cork 14 so that the hit cork 14 lands between the "single" marker strip 16 and the "double" marker strip 18. The getting step comprises getting by the batter player 26 a "double" point when the batter player 26 hits the thrown cork 14 so that the hit cork 14 lands between the "double" marker strip 18 and the "triple" marker strip 20. The garnering step comprises garnering by the batter player 26 a "triple" point when the batter player 26 hits the thrown cork 14 so that the hit cork 14 lands between the "triple" marker strip 20 and the "home run" marker strip 22. The earning step comprises earning by the batter player 26 a "home run" point when the hit cork 14 lands beyond the reposed down "home run" marker strip 22. The procuring step comprises procuring by the batter player 26 an "out" point when the batter player 26 hits the thrown cork 14 and when the pitcher player 28 catches the hit cork 14.

Another preferred embodiment of the method consists essentially of the steps of: attempting, choosing, designating, grasping, gripping, laying, obtaining, picking, placing, reposing, selecting, setting, standing, stepping, and throwing.

Yet another preferred embodiment of the method comprises the steps of: attempting, choosing, designating, earning, garnering, getting, grasping, gripping, laying, obtaining, picking, placing, procuring, receiving, reposing, securing, selecting, setting, standing, stepping, and throwing.

Referring now to FIG. 1 which depicts an overhead view of an preferred embodiment of the baseball-like game device 10 showing a bat 12; a cork 14 having a truncated conical shape; a "single" marker strip 16; a "double" marker strip 18; a "triple" marker strip 20; a "home run" marker strip 22; an optional "pitcher" marker strip 24, a batter player 26 and a pitcher player 28.

Refer now to FIG. 2, which depicts a closeup perspective view of the some of the components of a preferred embodiment of the baseball-like game device 10 showing the bat 12 and cork 14.

Refer now to FIG. 3, which depicts a top view of a preferred embodiment of some of the various marker strips of the baseball-like game device 10 showing a "single" marker strip 16; a "double" marker strip 18; a "triple" marker strip 20; and a "home run" marker strip 22.

As to the manner of usage and operation of the present invention, the same should be apparent from the above description. Accordingly, no further discussion relating to the manner of usage and operation will be provided.

While a preferred embodiment of the baseball-like game device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a baseball-like game device comprising the steps of obtaining the baseball-like game device comprising:

a bat;

a cork having a truncated conical shape;

a "single" marker strip;

a "double" marker strip;

a "triple" marker strip; and a "home run" marker strip;

picking out a first person to be a batter player;

designating a second person to be a pitcher player;

choosing a first location, the first location is where the batter player is to stand while playing the game device;

selecting a second location about ten feet away from the first location, the second location is where the pitcher player is to stand while playing the game device;

laying down the "single" marker strip behind the second location relative to the first and second locations so that a center of the laid down "single" marker strip is substantially in line with the first and second locations and so that the laid down "single" marker strip is laid out substantially perpendicular to a line defined by the first and second locations;

placing down the "double" marker strip behind the laid down "single" marker strip relative to the first and second locations so that a center of the placed down "double" marker strip is substantially in line with the first and second locations and so that the placed down "double" marker strip is placed down substantially perpendicular to the line defined by the first and second locations, wherein the placed down "double" marker strip is substantially parallel to the laid down "single" marker strip;

setting down the "triple" marker strip behind the placed down "double" marker strip relative to the first and second locations so that a center of the set down "triple" marker strip is substantially in line with the first and second locations and so that the set down "triple" marker strip is set down substantially perpendicular to the line defined by the first and second locations, wherein the set down "triple" marker strip is substantially parallel to the placed down "double" marker strip;

reposing down the "home run" marker strip behind the set down "triple" marker strip relative to the first and second locations so that a center of the reposed down "home run" marker strip is substantially in line with the first and second locations and so that the reposed down "home run" marker strip is reposed down substantially perpendicular to the line defined by the first and second locations, wherein the reposed down "home run" marker strip is substantially parallel to the set down "triple" marker strip;

standing onto the first location, said standing step performed by the batter player;

stepping onto the second location, said stepping step performed by the pitcher player;

grasping onto the bat, said grasping step performed by the batter player;

gripping onto the cork, said gripping step performed by the pitcher player;

throwing the cork towards the batter player, said throwing step performed by the pitcher player; and attempting to hit the thrown cork with the bat, said attempting step performed by the batter player.

2. The method of claim 1 further comprising the steps of:

receiving by the batter player a "strike" point when the batter player misses the thrown cork while attempting to hit the thrown cork;

securing by the batter player a "single" point when the batter player hits the thrown cork so that the hit cork lands between the "single" marker strip and the "double" marker strip;

getting by the batter player a "double" point when the batter player hits the thrown cork so that the hit cork lands between the "double" marker strip and the "triple" marker strip;

garnering by the batter player a "triple" point when the batter player hits the thrown cork so that the hit cork lands between the "triple" marker strip and the "home run" marker strip;

earning by the batter player a "home run" point when the hit cork lands beyond the reposed down "home run" marker strip; and procuring by the batter player an "out" point when the batter player hits the thrown cork and when the pitcher player catches the hit cork.

* * * * *